US005820405A

United States Patent [19]

Yagi et al.

[11] Patent Number: 5,820,405

[45] Date of Patent: *Oct. 13, 1998

[54] CONNECTOR WITH FITTING-INDICATION MECHANISM

[75] Inventors: Sakai Yagi; Tamio Watanabe; Toru Nagano, all of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 422,269

[22] Filed: Apr. 14, 1995

[30] Foreign Application Priority Data

Apr. 15, 1994 [JP] Japan ..... 6-077547

[51] Int. Cl.[6] ..... H01R 9/00

[52] U.S. Cl. ..... 439/489

[58] Field of Search ..... 439/488, 489, 439/350, 352, 353, 354, 359, 364; 411/8, 13, 14

[56] References Cited

U.S. PATENT DOCUMENTS 5,490,799 2/1996 Yamamoto ..... 439/489

FOREIGN PATENT DOCUMENTS 61-4179 1/1986 Japan .

2141881 1/1985 United Kingdom ..... 439/489

*Primary Examiner*—Hien Vu

*Attorney, Agent, or Firm*—Sughrue, Mion, Zinn, Macpeak & Seas, PLLC

[57] ABSTRACT

A connector fitting-indication mechanism that is provided with an indicator capable of accurately indicating a condition of fitting of two connectors when they are engaged, and can positively be returned to an original position upon disengagement of the connectors from each other. The indicator is in one connector and is releasably engageable with a portion of a second connector. When engaged, the indicator moves to an indicating position and when disengaged, the indicator moves to a position.

12 Claims, 4 Drawing Sheets

CONNECTOR WITH FITTING-INDICATION MECHANISM

BACKGROUND OF THE INVENTION

1. Field of the Invention

This invention relates to a multi-pole connector of the screw-tightening type used, for example, for a wire harness in an automobile, and more particularly to a connector fitting-indication mechanism for indicating a condition of mutual fitting of connectors.

2. Description of the Related Art

Currently, electronic devices are extensively used in automobiles, and as a result, the number of wires in the wire harness has increased, and connectors of the multi-pole type have been extensively used. In one known multi-pole connector of the screw-tightening type, a single bolt for fitting purposes is threaded into one of a pair of female and male connector housings having female and male terminals attached thereto, respectively. By tightening this single bolt, the two connector housings are uniformly fitted together.

FIG. 6 shows one example of a conventional screw tightening-type connector in which a nut 80A is fixedly secured to a generally central portion of a front end (fitting side) of a male connector housing 80, and a bolt holder portion 82 is provided at that side of a female connector housing 81 at which terminal insertion holes are provided. A conventional bolt 83 is threaded into the bolt holder portion 82 in order to join housings 80 and 81.

Specifically, when the male and female connector housings 80 and 81 are fitted together, the conventional bolt 83 is aligned with the nut 80A, and by threading the bolt 83, the male and female connectors 80 and 81 are completely fitted together. At this time, if a normal fitting is achieved, an indication piece (not shown) for fitting confirmation purposes is pushed out to the front end face of the male connector housing 80, and is exposed to a fitting confirmation hole 84 formed in the bolt holder portion 82, so that this indication piece can be viewed with the eyes.

Next, a conventional fitting indication mechanism will be described with reference to FIGS. 7 and 8. As shown in FIG. 7, an annular projection 71A is formed on an inner periphery of a tubular body 71 at one end thereof, and a central opening thereof serves as a confirmation hole 72. An indication rod 75 is inserted in the tubular body 71, and a front end thereof is bifurcated into resilient indication pieces 75A and 75B. Distal ends of the resilient indication pieces 75A and 75B are colored to form colored indication portions 75*c* and 75D, respectively.

When male and female connector housings are fitted together, the rear end of the indication rod 75 is pushed by the male connector housing 76 as shown in FIG. 8, so that the whole of the indication rod 75 is moved to the left in the drawings. As a result, the resilient indication pieces 75A and 75B are elastically deformed inwardly along a tapered surface of the annular projection 71A, and are stopped to close the confirmation hole 72.

In this condition, the colored indication portions 75C and 75D are exposed over the entire area of the confirmation hole 72, and the colored indication portions 75C and 75D can be viewed with the eyes from the outside of the confirmation hole 72, and therefore the condition of mutual fitting of the male and female connector housings can be confirmed through visual observation of the colored indication portions 75C and 75D.

In the above conventional fitting indication mechanism, however, if the resilient indication pieces 75A and 75B are kept elastically deformed for a long period of time, their restoring force is lowered, and when the male and female connector housings are disengaged from each other, these indication pieces fail to be restored into their initial configuration. In this case, when the connector housings are again fitted together, the condition of mutual fitting of the connectors can not be confirmed. Namely, even in an incompletely-fitted (half-fitted) condition, the colored indication portions 75C and 75D can be viewed with the eyes, thus providing an incorrect indication, which results in a problem in that it can not be judged whether the fitted condition has been achieved.

It is an object of this invention to provide a connector fitting-indication mechanism provided with an indicator which is capable of accurately indicating a condition of fitting the connectors, and can positively be returned into an original position upon disengagement of the connectors from each other.

SUMMARY OF THE INVENTION

The above object of the present invention has been achieved by a fitting indication mechanism for a connector in which a bolt rotatably mounted on a first connector housing is threaded in a nut mounted on a second connector housing so that the first and second connector housings can be fitted together and disengaged from each other. This fitted condition is indicated by an indicator that has at one end a fitting confirmation portion which projects from the first connector housing when the connector is brought into the fitted condition. The indicator has at its other end a retaining hole with which a retaining projection formed at the front end of the second connector housing is engaged during a connector fitting operation. The indicator also has a stopper portion for releasing the engagement of the retaining hole with the retaining projection during a connector disengaging operation.

The above object has been achieved by an apparatus in which the engagement of the retaining hole with the retaining projection is released by abutting the stopper portion against a step portion, formed in the first connector housing, during the connector disengagement operation.

The above object has been achieved by an apparatus in which the retaining hole is defined by a pair of elastic pieces.

The above object has been achieved by an apparatus in which the stopper portion comprises a pair of elastic members.

The above object has been achieved by an apparatus in which a projection for provisionally retaining the indicator is provided in the vicinity of a window portion into which the fitting confirmation portion projects when the connector is brought into the fitted condition.

The above object has been achieved by an apparatus in which at least the fitting confirmation portion of the indicator is colored differently than that of the first connector housing.

In the connector fitting-indication mechanism according to the present invention, the indicator has at one end the fitting confirmation portion which projects from the rear end of the first connector housing when the connector is in the fitted condition, and the indicator has at its other end the retaining hole with which the retaining projection formed at the front end of the second connector housing is engaged during the connector fitting operation, and the indicator has the stopper portion for releasing the engagement of the retaining hole with the retaining projection during the connector disengaging operation.

Therefore, the indicator is moved or advanced during the connector fitting operation after the retaining projection is engaged in the retaining hole, and the fitting confirmation portion, colored differently than the first connector housing, slides past the projection in the first connector housing, and is exposed to the window portion open to the rear end of the housing so that it can be confirmed by eye that the first and second connector housings are properly fitted together.

For disengaging the thus fitted first and second connector housings from each other, the bolt is rotated in a reverse direction to move the two connector housings in a direction away from each other, and in accordance with this movement, the indicator is returned while pulled by the retaining projection since the retaining projection is engaged in the retaining hole. Then, the fitting confirmation portion slides over the projection in a direction opposite to the direction of advancing movement, so that it can be not viewed by eye, thus enabling confirmation of the disengaged condition. When the indicator is further returned by the rotation of the bolt, the stopper portion is brought into abutment with the step portion in the first connector housing, so that the retaining projection becomes disengaged from the retaining hole, and the first and second connector housings are completely separated from each other.

Thus, in the normal fitted condition, the indicator is not elastically deformed, and the indicator is positively returned to a predetermined provisionally-retained position after the connector-disengagement operation.

DESCRIPTION OF THE PREFERRED EMBODIMENTS

Figure 1:
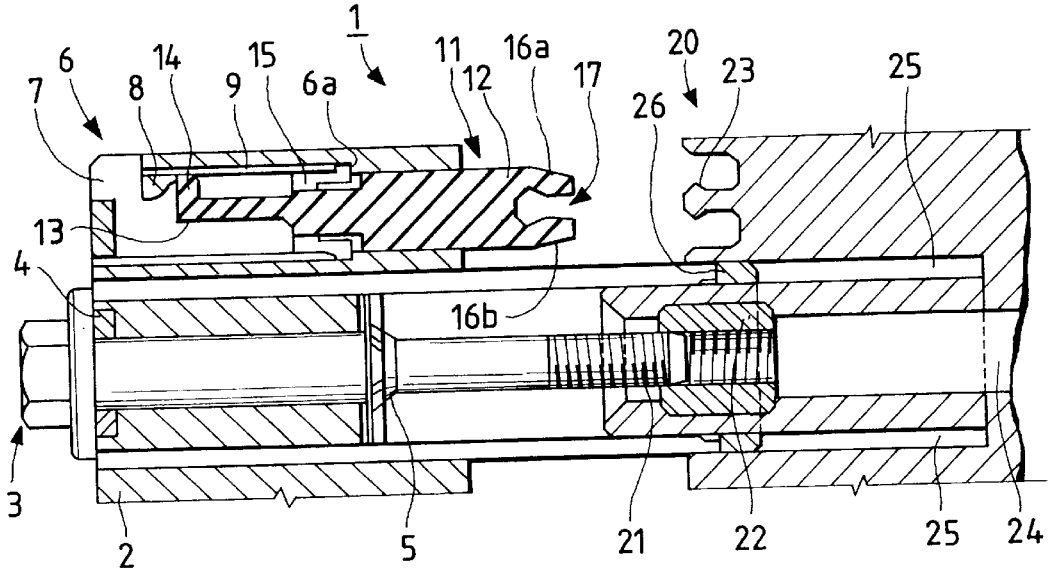
FIG. 1 is a cross-sectional view of a preferred embodiment of a connector fitting-indication mechanism according to the present invention.
Figure 3:
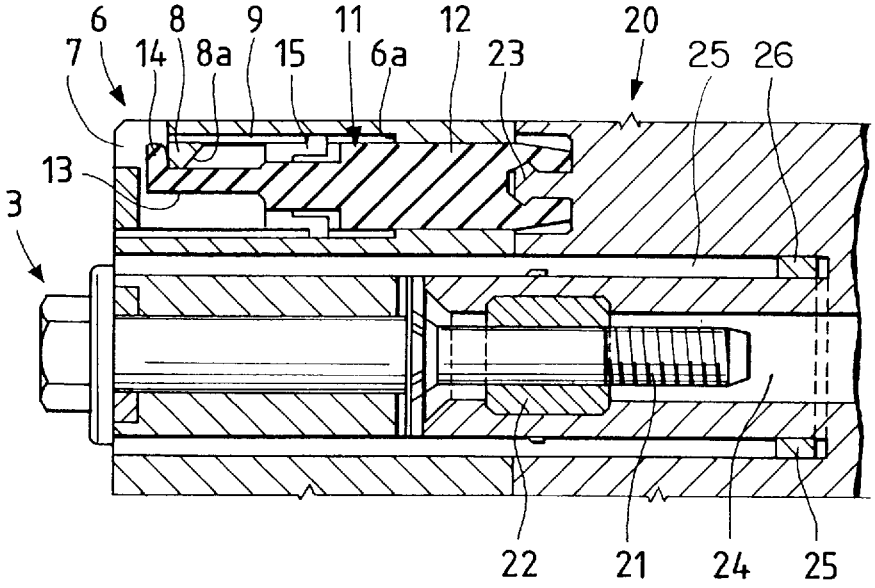
FIG. 3 is a cross-sectional view showing a fitted condition of the connector of FIG. 1.
Figure 4:
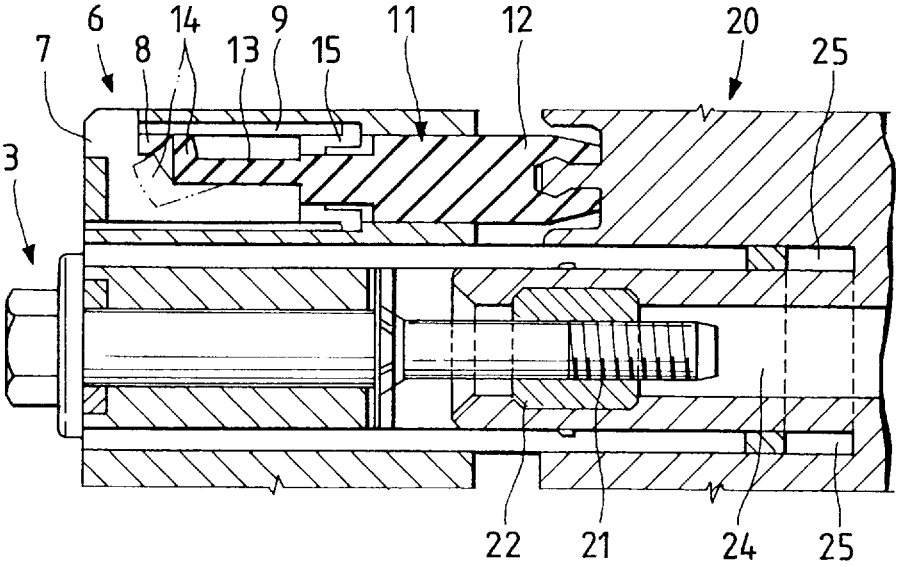
FIG. 4 is a cross-sectional view showing an initial stage of disengagement of the connector of FIG. 1.
Figure 5:
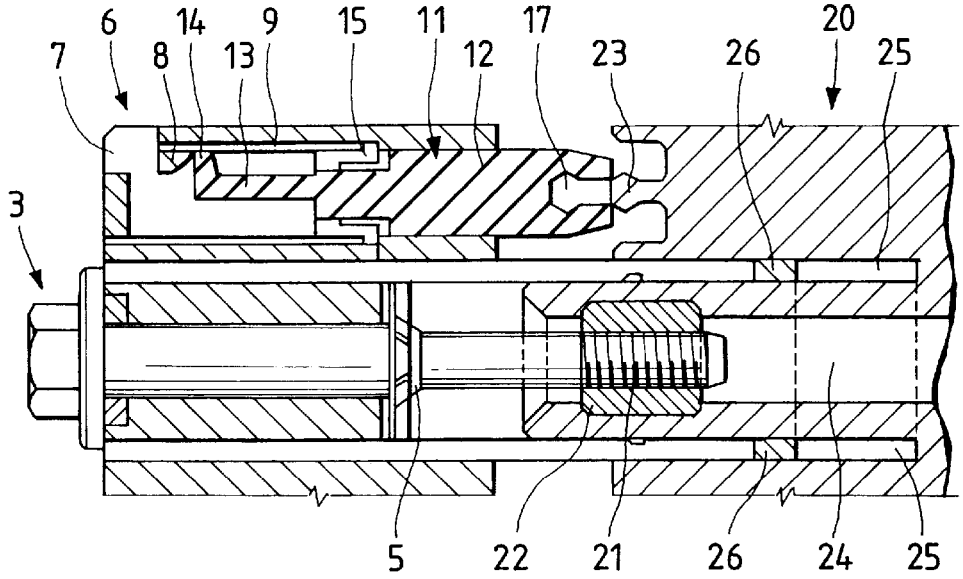
FIG. 5 is a cross-sectional view showing a process of disengagement of the connector in FIG. 3.
Figure 6:
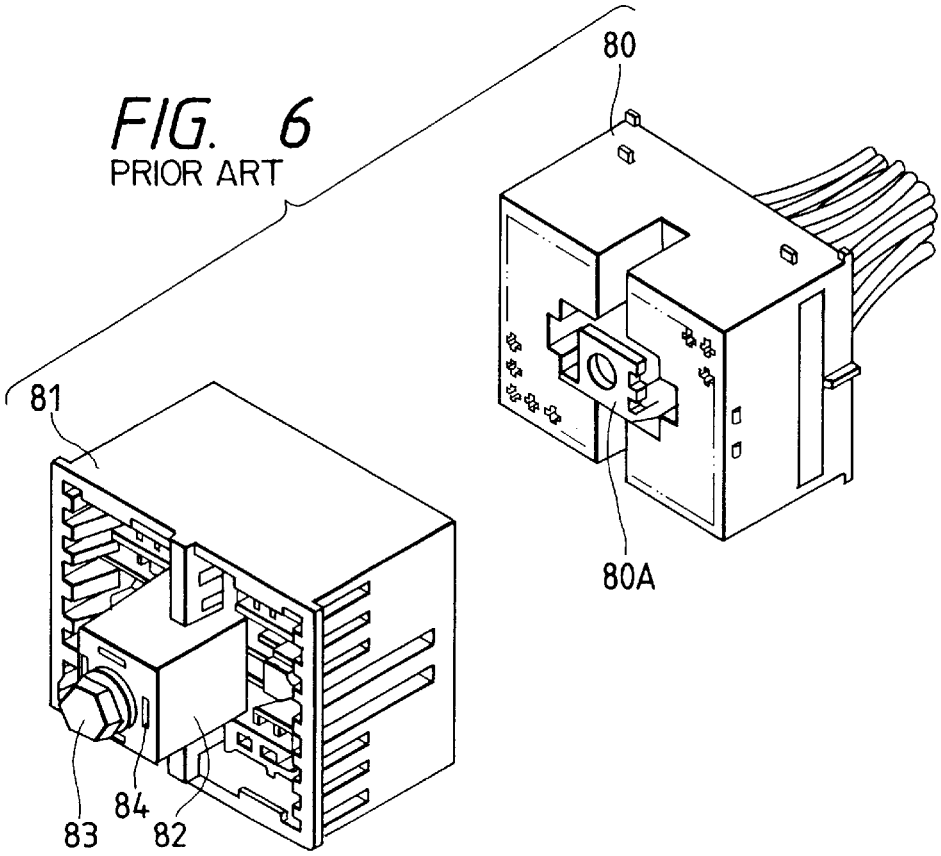
FIG. 6 PRIOR ART
FIG. 6 is a perspective view of a conventional connector of the screw-tightening type.
Figure 7:
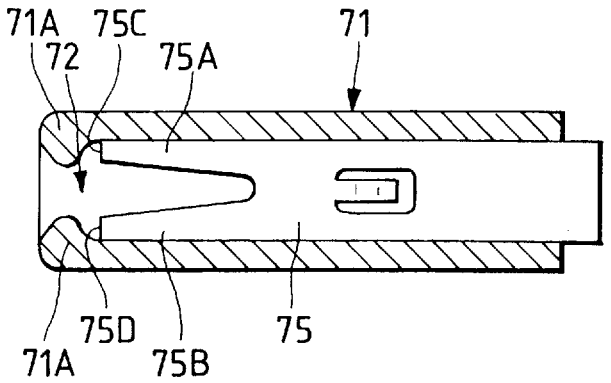
FIG. 7 PRIOR ART
FIG. 7 is a cross-sectional view of a conventional indicator in a provisionally-retained condition.
Figure 8:
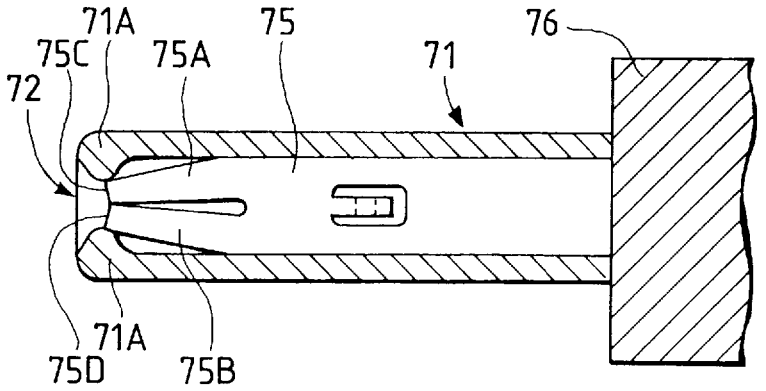
FIG. 8 PRIOR ART
FIG. 8 is a cross-sectional view showing a deformed condition of the indicator of FIG. 6.

One preferred embodiment of a connector fitting-indication mechanism of the present invention will now be described in detail with reference to FIGS. 1 to 5. FIG. 1 is a cross-sectional view of the connector fitting-indication mechanism of the invention, FIG. 2 is a perspective view of an indicator in FIG. 1, FIG. 3 is a cross-sectional view showing a condition in which the mutual fitting of connectors of FIG. 1 is completed, FIG. 4 is a cross-sectional view showing an initial stage of disengagement of the connectors from each other, and FIG. 5 is a cross-sectional view showing a condition in which the disengagement of the connectors from each other is completed.

In the connector 1 of the screw-tightening type shown in FIG. 1, a bolt 3 is inserted in a bolt holder portion 2 formed in a projected manner at a central portion of a first connector housing 6, and this bolt 3 is held against withdrawal by a washer 4 and a bolt stopper 5, but is rotatable. An indicator 11 (described later) is supported within the first connector housing 6 for reciprocal movement, and one end of the indicator 11 can be projected into a window portion 7 open to a rear end of the first connector housing 6. A projection 8 for provisionally-retaining purposes is formed facing to the window portion 7, and an inner surface of this projection 8 is slanting. Longitudinally-continuous guide grooves 9 are formed in an inner wall surface of the first connector housing 6.

Figure 2:
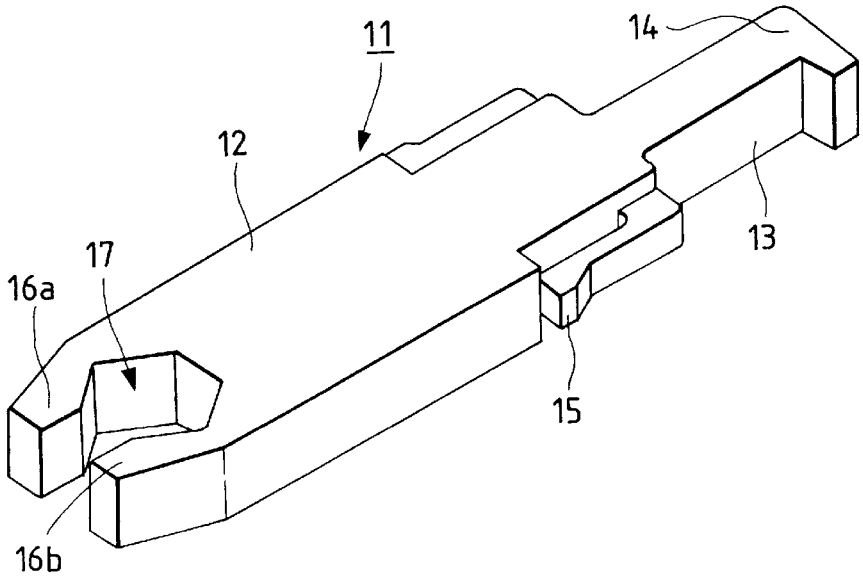
FIG. 2 is a perspective view of the indicator of FIG. 1.

As shown in FIG. 2, the indicator 11 is in the form of a plate, and has a resilient indication piece 13 of a smaller cross-section extending longitudinally from a front end of a base portion 12, and a fitting confirmation portion 14 of a hook-shape is formed at a distal end of this indication piece 13, the fitting confirmation portion 14 being colored differently than the first connector housing 6. A pair of elastic stoppers 15 are formed respectively on opposite sides of the base portion 12 intermediate opposite ends thereof. A retaining hole 17 (first engagement structure) is formed at the rear end of the base portion 12, and is defined by a pair of opposed elastic pieces 16*a* and 16*b*, the retaining hole 17 being constricted at its inlet portion, and being enlarged at its inner portion.

A nut 22 for threaded engagement with the bolt 3 is mounted on a mating second connector housing 20 in an embedded manner, and this housing 20 has a retaining projection 23 for engagement in the retaining hole 17 of the indicator 11 in a retained position of the indicator 11. The width of this retaining projection 23 is larger than the dimension of the inlet of the retaining hole 17 formed between the elastic pieces 16*a* and 16*b*. However, since the elastic pieces 16*a* and 16*b* have elasticity, the retaining projection 23 (second engagement structure) can be inserted into the retaining hole 17, and also can be moved out of this hole in a direction opposite to this inserting direction. Guide grooves 25 for respectively guiding guide members 26 of the bolt holder portion 2 are formed in that portion surrounding that portion at which the nut 22 is embedded.

Next, the fitting of the first and second connector housings 6 and 20, as well as an indication operation, will be described.

Front end portions of the guide members 26 formed on the bolt holder portion 2 of the first connector housing 6 are inserted respectively in the guide grooves 25 formed in the second connector housing 20, thereby achieving a provisionally-retained condition, as shown in FIG. 1. In this condition, a front end of a threaded portion 21 of the bolt is held against a peripheral edge of the nut 22 so that the bolt can be threaded into the nut.

The indicator 11 is held in a provisionally-retained condition, with each stopper 15 held against a step 6*a* formed at the end of the associated guide groove 9 in the first connector housing 6. In this condition, the indicator cannot be withdrawn. The fitting confirmation portion 14 is disposed immediately adjacent to the inner surface of the projection 8, and can not be viewed with the eyes through the window portion 7, and the indicator 11 is spaced apart from the retaining projection 23.

Then, in the provisionally-retained condition, when the bolt 3 is threaded, the two connector housings 6 and 20 are moved toward each other, and the retaining projection 23 engages and forces the elastic pieces 16*a* and 16*b* away from each other, so that the retaining projection 23 becomes engaged in the retaining hole 17. In this condition, when the bolt 3 is further threaded, the whole of the indicator 11 is moved toward the rear end of the first connector housing 6. Then, the fitting confirmation portion 14 slides past the slanting surface 8*a* of the projection 8, and is exposed to the window portion 7 as shown in FIG. 3, so that the condition of fitting of the connector can be confirmed with the eyes.

For disengaging the two connector housings 6 and 20 from each other as shown in FIG. 4, the bolt 3 is rotated in a direction opposite to the rotating direction for the fitting operation. At this time, since the retaining projection 23 is engaged in the retaining hole 17, the indicator 11 is drawn away from the front end of the first connector housing 6. Then, in contrast to the fitting operation, the fitting confirmation portion 14 slides over the outer surface of the projection 8 facing the window portion 7, and slides down the slanting surface 8*a* in response to the rotation of the bolt 3. Then, each stopper 15 is again abutted against the associated step 6*a*, thereby stopping the movement of the whole of the indicator 11. As a result, the fitting confirmation portion 14 is again located immediately adjacent to the inner surface of the projection 8, and can not be viewed with the eyes, so that it can be confirmed that the connector is not in the fitted condition.

At least the fitting confirmation portion 14 of the indicator 11 is colored differently than the first connector housing 6, and therefore visual confirmation through the window portion 7 can be carried out more accurately.

When the bolt 3 is further rotated, the retaining projection 23 forces the elastic pieces 16*a* and 16*b* away from each other and is thereby disengaged from the retaining hole 17 as shown in FIG. 5, since the indicator 11 is unable to move. Then, a further rotation of the bolt 3 causes the bolt 3 to be brought out of threaded engagement with the nut 2, so that the two connector housings 6 and 20 are completely separated from each other.

As described above, in the connector fitting-indication mechanism of the present invention, the indicator has at one end the fitting confirmation portion which projects from the rear end of the first connector housing when the connector is in the fitted condition, and the indicator has at its other end the retaining hole in which the retaining projection formed at the front end of the second connector housing is engaged during the connector fitting operation, and the indicator has the stopper portion for releasing the engagement of the retaining hole with the retaining projection during the connector disengaging operation.

Therefore, when disengaging the fitted first and second connector housings from each other, the whole of the indicator is returned while pulled by the second connector housing since the retaining projection is engaged in the retaining hole. Then, when the stopper portion is brought into abutment with the step of the first connector housing, the retaining projection is disengaged from the retaining hole, and the first and second connector housings are completely separated from each other.

When the first and second connector housings are fitted together, the fitting confirmation portion, different in color from the first connector housing, is completely exposed in the window portion, and the condition of fitting can be accurately confirmed. Furthermore, the fitting confirmation portion is not elastically deformed, and will not be plastically deformed even if the fitted condition is maintained for a long period of time.

Therefore, the proper fitted condition of the connector, as well as a half-fitted condition, can be clearly recognized visually, and the indicator is positively returned to the provisionally-retained position upon disengagement of the connector. Therefore the reliability of the fitting confirmation mechanism is greatly enhanced.

While the present invention has been defined with respect to a single preferred embodiment, the invention is not limited thereto and various modifications thereof would be easily apparent to one of ordinary skill in the art. For example, the second housing may have a pair of elastic pieces operative to engage a projection on indicator 11. Accordingly, the invention is to be defined according to the claims, as interpreted by one of ordinary skill in the art.

What is claimed is:

1. A fitting indication mechanism for a connector, said connector comprising a first connector housing and a second connector housing which are engageable with each other in a fitted condition by movement of said second connector housing in a first direction, and disengageable with each other by movement of said second connector housing in a second, disengaging direction, said fitting indication mechanism comprising:

an indicator, slidably disposed in said first connector housing so as to be moveable between first and second positions, said indicator having a fitting confirmation portion at a first end thereof which is visible through an opening at an end of said first connector housing when said indicator is in said first position to indicate said fitted condition, and said indicator having a resilient retaining hole at a second end thereof; and a retaining projection, associated with said second connector housing, for temporarily engaging with said retaining hole of said indicator such that when said first and second connector housings are disengaged by movement of said second connector housing in said second disengaging direction, said indicator is pulled by said second connector housing in said second disengaging direction to said second position such that said fitting confirmation portion is no longer visible through said opening;

said indicator further comprising a stopper portion abuttable against an inner surface of said first connector housing for preventing movement of said indicator further in said disengaging direction from said second position such that said retaining projection is released from the engagement with said retaining hole of said indicator of said first connector housing when said second connector housing is moved in said disengaging direction.

2. A fitting indication mechanism for a connector according to claim 1, wherein said first connector housing further comprises a step portion for abutting said stopper portion to prevent movement of said indicator further in said disengaging direction.

3. A fitting indication mechanism for a connector according to claim 1, in which said retaining hole is defined by a pair of elastic pieces.

4. A fitting indication mechanism for a connector according to claim 1, in which said stopper portion comprises a pair of elastic members.

5. A fitting indication mechanism for a connector according to claim 1, wherein said opening in said first connector housing comprises a window portion into which said fitting confirmation portion at least partially projects when said connector is in said fitted condition and said first connector housing further comprises a projection for provisionally retaining said indicator in the vicinity of said window portion.

6. A fitting indication mechanism for a connector according to claim 1, wherein at least said fitting confirmation portion of said indicator is colored differently than said first connector housing.

7. A connector with a fitting indication mechanism comprising:

a first connector housing having a first engagement structure;

a second connector housing having a front end and a second engagement structure disposed at said front end which is engageable with said first engagement structure, said first and second connector housings being engageable with each other by movement of said second connector housing in a first engaging direction, and disengageable with each other by movement of said second connector housing in a second disengaging direction, so that said first and second connector housings can be fitted together in a fitted condition; and an indicator, slidably disposed in said first connector housing so as to be moveable between first and second positions, and having first and second ends, said indicator having at said first end a fitting confirmation portion which is visible through an opening at an end of said first connector housing when said indicator is in said first position to indicate said fitted condition, said indicator having at said second end a first engagement structure engageable with said second engagement structure, such that when said first and second connector housings are disengaged by movement of said second connector housing in said second disengaging direction, said indicator is pulled by said second engagement structure in said second disengaging direction to said second position such that said fitting confirmation portion is no longer visible through said opening;

said indicator further comprising a stopper portion abuttable against an inner surface of said first connector housing for preventing movement of said indicator further in said disengaging direction from said second position such that the engagement of said first engagement structure with said second engagement structure is released when said second connector housing is further moved in said disengaging direction.

8. A connector according to claim 7, in which said first connector housing further comprises a step portion for abutting said stopper portion to prevent movement of said indicator further in said disengaging direction.

9. A connector according to claim 7, in which said second structure comprises a retaining hole defined by a pair of elastic pieces.

10. A connector according to claim 7, in which said stopper portion comprises a pair of elastic members.

11. A connector according to claim 7, wherein said opening in said first connector housing comprises a window portion into which said fitting confirmation portion at least partially projects when said connector housings are in said fitted condition, and said first connector housing further comprises a projection for provisionally retaining said indicator in the vicinity of said window portion.

12. A connector according to claim 7, wherein at least said fitting confirmation portion of said indicator is colored differently than at least one of said first and second connector housings.

* * * * *